US006769882B2

(12) United States Patent
Cowans

(10) Patent No.: US 6,769,882 B2
(45) Date of Patent: Aug. 3, 2004

(54) PRESSURE COMPENSATION FOR LOCALIZED BEARING HEATING IN PUMPS DRIVEN BY MOTORS WITH FLUID FILLED ROTORS

(75) Inventor: Kenneth W. Cowans, Fullerton, CA (US)

(73) Assignee: Advanced Thermal Sciences Corp., Anaheim, CA (US)

( * ) Notice: Subject to any disclaimer, the term of this patent is extended or adjusted under 35 U.S.C. 154(b) by 0 days.

(21) Appl. No.: 10/164,028

(22) Filed: Jun. 5, 2002

(65) Prior Publication Data

US 2003/0228232 A1 Dec. 11, 2003

(51) Int. Cl.[7] ..... F04B 17/03
(52) U.S. Cl. ..... 417/357; 310/90; 417/366
(58) Field of Search ..... 310/90; 417/44.1, 417/44.11, 45, 357, 366

(56) References Cited

U.S. PATENT DOCUMENTS 2,190,246 A * 2/1940 Schirmer ..... 417/366
3,031,973 A * 5/1962 Kramer ..... 417/357
3,195,466 A * 7/1965 Young ..... 417/357
3,225,698 A * 12/1965 Spisiak ..... 417/357
3,291,056 A * 12/1966 Steinman ..... 417/357
3,572,976 A * 3/1971 Sato ..... 310/90
4,644,202 A * 2/1987 Kroy et al. ..... 310/90
5,040,954 A * 8/1991 Iwai ..... 310/90
5,248,245 A * 9/1993 Behnke et al. ..... 417/366
6,065,946 A * 5/2000 Lathrop ..... 417/44.1
6,068,455 A 5/2000 Cowans
6,447,269 B1 * 9/2002 Rexroth et al. ..... 417/366

* cited by examiner

*Primary Examiner*—Michael Koczo
(74) *Attorney, Agent, or Firm*—Jones, Tullar & Cooper PC

(57) ABSTRACT

A motor/pump system which uses an enclosed rotor shell, and also interior hydrodynamic bearings which are lubricated by the liquid being pumped, is arranged to minimize localized heating at the bearings to vaporization levels under high load conditions. To this end output pressure from the pump, which varies with load, is communicated into the rotor interior, without bulk fluid transfer. The increased pressure raises the vaporization temperature, automatically adjusting it with increased load to maintain the hydrodynamic bearing effect.

8 Claims, 4 Drawing Sheets

PRESSURE COMPENSATION FOR LOCALIZED BEARING HEATING IN PUMPS DRIVEN BY MOTORS WITH FLUID FILLED ROTORS

FIELD OF THE INVENTION

This invention relates to pumps driven by motors having fluid filled rotors, and more particularly to such pumps which use pressurized liquids within the rotor to maintain hydrodynamic bearing surfaces.

BACKGROUND OF THE INVENTION

A low cost and highly reliable pumping system for use in critical applications, such as applications in which a thermal transfer fluid is directed through a tool that must be maintained at a particular temperature, is provided by a system described in U.S. patent application Ser. No. 09/906,624, entitled "Pump System Employing Liquid Filled Rotor", now U.S. Pat. No. 6,626,649, having Kenneth W. Cowans as inventor. In this system, the same thermal transfer fluid that is being pumped is also confined within a sealed rotor housing and used to serve as the fluid for supporting internal hydrodynamic bearings, even though the temperature of the thermal transfer fluid, as well as its viscosity, may be required by process conditions to vary within a substantial range. Typical thermal transfer fluids, such as a proprietary fluid sold under the trademark "Galden", or as one alternative a fifty/fifty mixture of glycol and water, neither solidify nor vaporize even though the hot and cold temperature limits vary widely. The design of the motor and pump system is such that thermal energy transfers between them are limited in all respects, specifically conduction through solids, conduction in the liquid, and convection. Thus the mean temperature within the enclosed rotor varies little, even though the temperature of the fluid circulated by the pump is at a much higher or lower level.

It has been found, however, that under certain high load conditions, the localized temperature of the hydrodynamic films at the bearings within the rotor shell can substantially increase. In fact, the temperatures in these specific volumes can approach the vaporization point if the thermal transfer fluid being pumped is also in a higher temperature range. While the motor structure can be redesigned so that conductive fins dissipate some of this localized heat, this adds undesirably to cost, and sacrifices compactness. It is therefore desirable to preclude such localized fluid vaporization problems without imposing limitations on the operation of the pump/motor system, or employing special cooling structures for the bearings.

SUMMARY OF THE INVENTION

A pumping system employing a motor with a liquid filled rotor in accordance with the invention utilizes a regenerative turbine pump having an inlet angularly separated from the outlet for the pump, and an interior chamber in the pump housing that is in communication with an interior chamber within the fluid filled rotor of the motor. The passageways between the pump and the rotor communicate pressure without fluid transport, which would tend to equalize the temperature throughout the rotor chamber to the variable temperature at the pump.

In accordance with the invention, however, the volume within the pump chamber which communicates with the rotor interior is opened via conduits to the higher pressure at the pump outlet. This higher pressure in turn is established within the rotor interior. Such communication does not affect the pump operation, inasmuch as the substantial differential between inlet and outlet pressure is maintained. However, the increase in pressure within the rotor interior, which is dependent on the load on the pump, is highly significant. Under periods of high pump loading, when the local hydrodynamic bearing temperature tends to reach a peak, the pressure at the bearings is correspondingly increased. This consequently increases the fluid vaporization temperature level, automatically counteracting any boil off tendency at the bearing, while not otherwise affecting operation. Consequently, catastrophic or bearing fatigue effects which would be inimical to the desired goal of long life reliable operation of the pump, are avoided.

In a more specific example of a system in accordance with the invention, the regenerative turbine pump includes a turbine mounted within a pump housing that encompasses a protruding end of the motor shaft. The rotor housing incorporates bearing surfaces about the shaft on each axial side of the rotor. The pump inlet is parallel to the axis of rotation of the turbine, and the pump outlet is tangential relative to that the axis, the inlet and outlet being isolated from each other except for a circumferential channel about the turbine circumference. Blades on each side of the periphery of the turbine disk occupy most of the channel cross section. Fluid communication between the interior of the pump housing and the rotor shell interior is provided through an axial shaft conduit that extends between them. A small fluid interlink conduit in the pump housing between the pump outlet and the interior pump chamber hydraulically raises the interior rotor pressure with load via pathways extending between the high pressure turbine disk region and the rotor interior volume around the shaft. This provides pressure responsive temperature stabilization which avoids local heating in the bearing areas to levels which might approach the pressure adjusted vaporization temperature of the fluid.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 5:
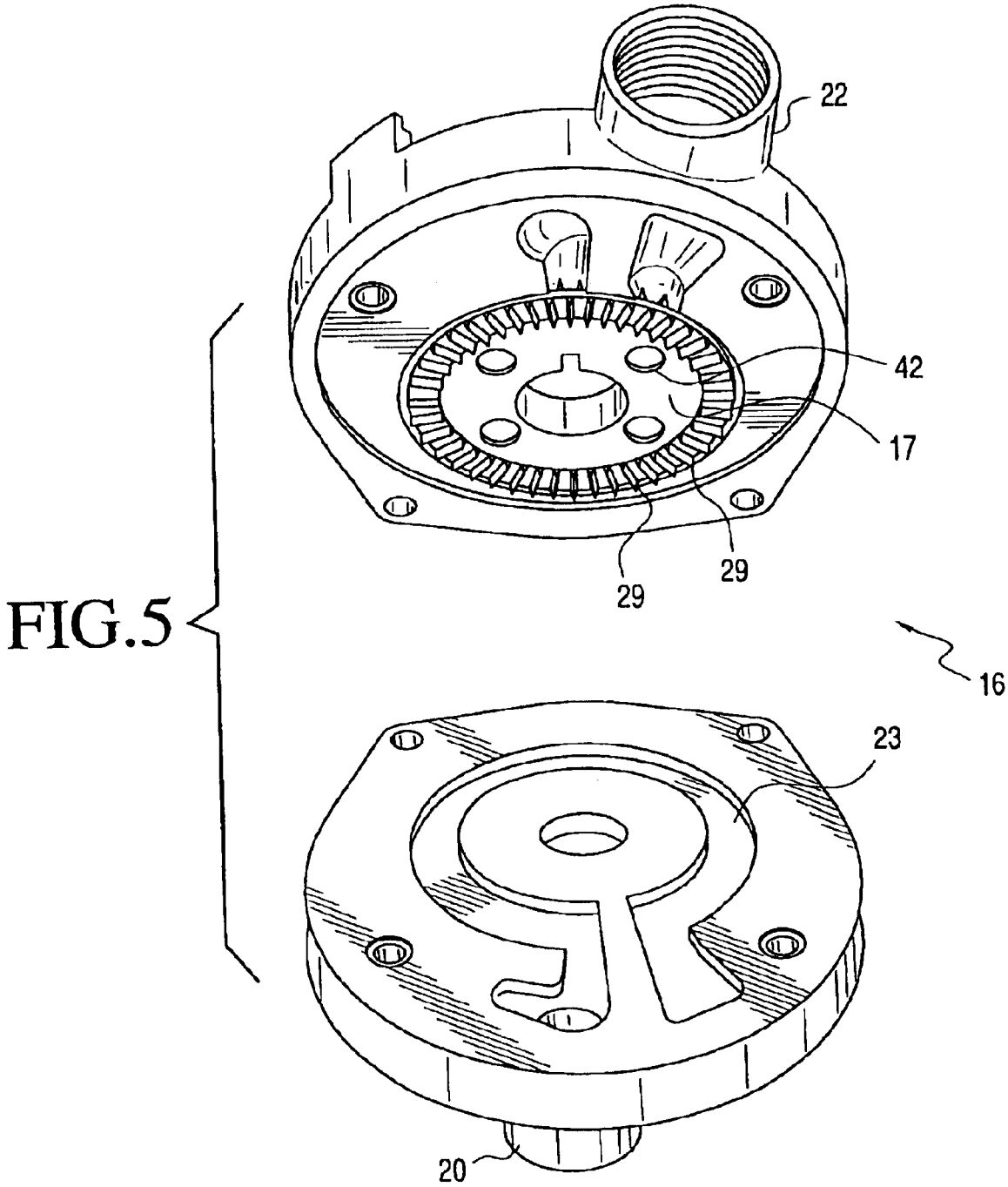
FIG. 5 is a perspective exploded view of the components of the pump.

In a system in accordance with the invention, referring now to FIGS. 1–5, an induction motor 10 having a liquid filled rotor 12 with a shaft 14 having a shaft end 15 extending from the rotor housing 13 is fully sealed against leakage, with the shaft end 15 extending to within a pump housing 18 with a narrow circumferential chamber for receiving a regenerative turbine pump 16 having a disk body 17 mounted on the shaft end 15. The pump housing 18 is also enclosed except for an axial inlet 20 and a radial outlet 22, each leading to an opposite side of a peripheral channel 23 that extends about the outer circumference of the disk 17. The inlet 20 and the outlet 22 are angularly separated relative to the pump periphery, as is more clearly shown in FIG. 5. A central or second interior chamber 24 concentric with and about the shaft end 15 is defined between the pump housing 18 and adjacent rotor housing 13. The chamber 24 is separated by a portion of the pump housing wall from the outlet port 22. Turbine blades 29 on the opposite sides of the periphery of the disk body 17 are in communication with the inlet and outlet ports 20, 22, respectively, and lie within the different sides of the peripheral channel 23. The halves of the pump housing 18, however, includes a barrier which separates the flow at the inlet port from that at the outlet port 22 as seen in FIG. 5. The narrower circumferential chamber in the housing which receives the turbine disk body 17 has side wall surfaces which are spaced apart from, but close to, the body 17.

The pump 16 is driven by the motor shaft 14 to supply pressurized thermal transfer fluid to a temperature controlled processor unit or process tool 30 (FIG. 1 only), which may be a cluster tool for making precise parts, such as semiconductors. The induction motor 10 is operated by drive circuits 34 which respond to signals from a controller 36 to provide rotational velocity for the desired flow rate for the then current operating needs of the processor unit 30. The temperature of the thermal transfer fluid that is being supplied is regulated prior to input to the unit 30 by a temperature control unit 38 also governed by the processor unit 30.

Figure 1:
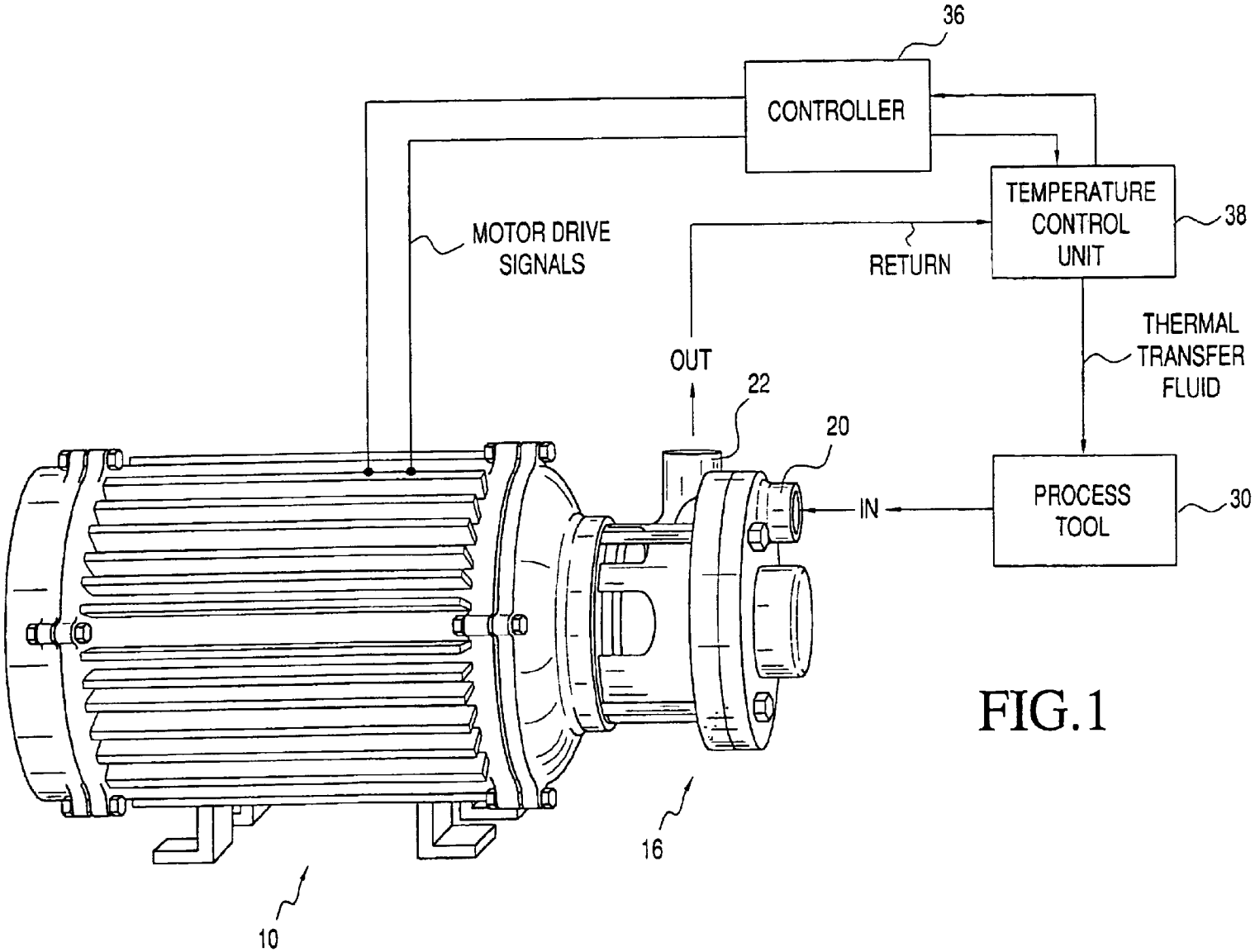
FIG. 1 is a perspective view, partially broken away, of a variable temperature and variable load system for supplying thermal transfer fluid to a unit to be temperature controlled.
Figure 2:
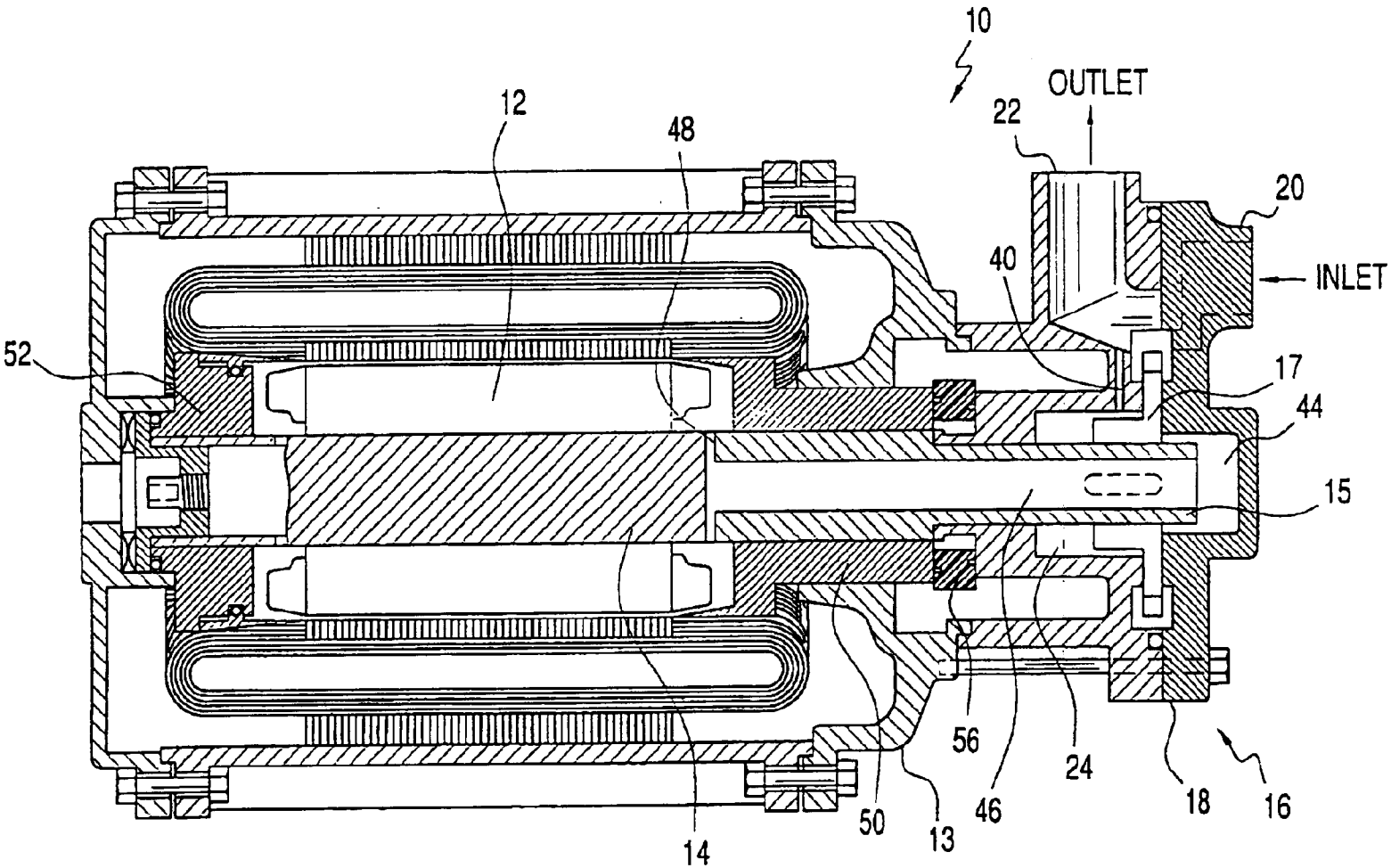
FIG. 2 is a side sectional view of the pump and motor combination of FIG. 1.
Figure 4:
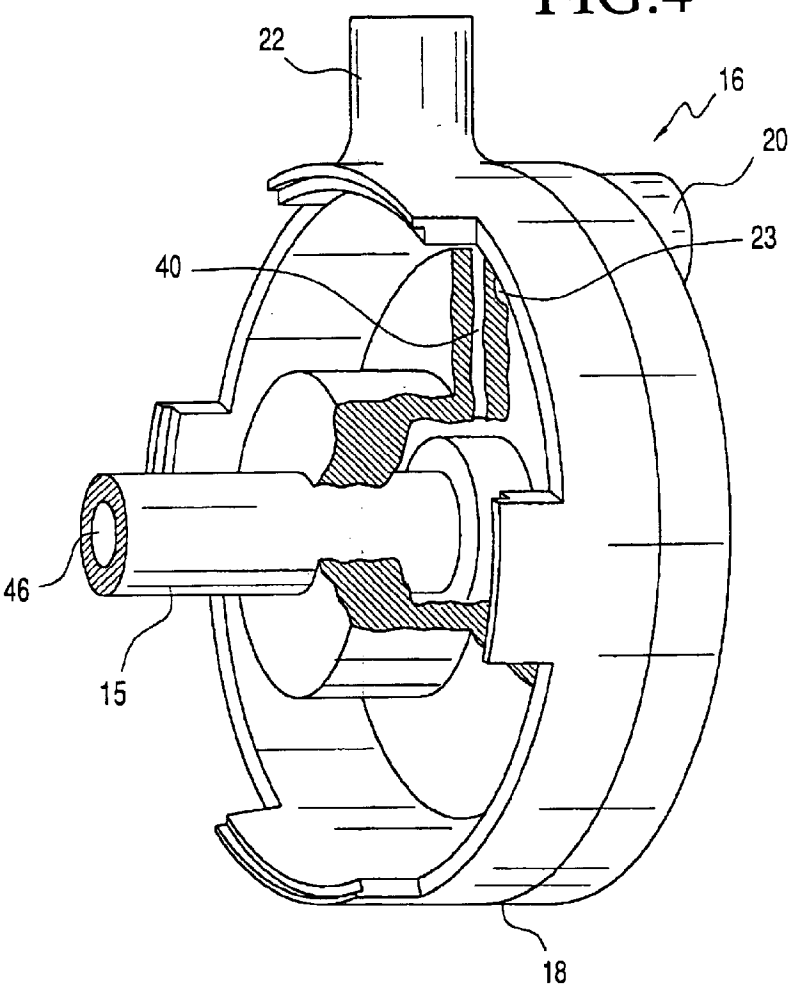
FIG. 4 is a fragmentary perspective view of the pump housing of FIG. 2.
Figure 3:
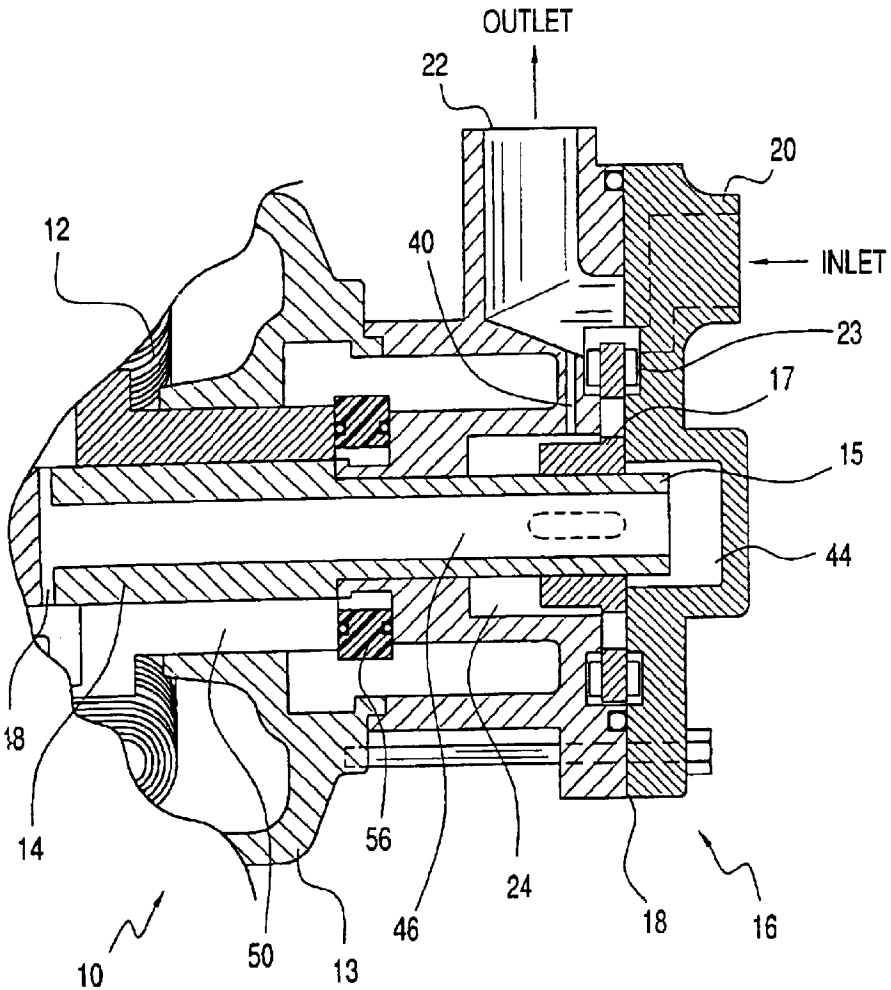
FIG. 3 is a fragmentary sectional view of the pump housing of FIG. 1, showing further details thereof.

The housing 18 of the pump 16 includes a small (typically less than about 5 mm diameter) pressure communicating aperture 40 (FIGS. 2–4 only) between the inside wall of the outlet port 22 and the interior chamber 24 of the housing 18. This aperture 40, which is in this example between about 1 mm and about 1.5 mm in diameter, is a first pressure communication conduit that does not circulate fluid but raises the pressure to a higher level in the chamber 24. The interior chamber 24 between the pump housing 18 and the rotor housing 13 communicates pressure through the turbine disk 17 volume via flow holes 42 (FIG. 5), small spacings (not readily visible at this scale) between the walls of the housing 18 and the disk body 17, and into a pump end chamber 44 (FIGS. 2 and 3) about the shaft end 15. An axial conduit 46 in the shall end 15 is open to the end chamber 44, and extends into the interior volume within the rotor housing or enclosure 13, where radial apertures 48 open into the rotor housing 13 interior, forming a second pressure communication conduit. These end openings of the apertures 48 are on the inside of a first hydrodynamic bearing 50 which is on the pump side of the rotor 12, and which is formed by a smooth (e.g. silver) plating on the inner cylindrical surface of a part of the rotor housing 13. Such an arrangement is reliable and particularly cost effective. At the opposite end of the rotor 12, a second hydrodynamic bearing 52 (FIG. 2 only) is mounted about the shall 14, and comprises a like plated concentric structure receiving the shaft 14. Pressure communication within the rotor housing 13 is thus via the gap between the shaft 14 and the rotor windings. The rotor housing 13 and pump housing 18 are both stationary, and a seal member 56 with interior O rings is disposed between these abutting surfaces, as seen in FIGS. 2 and 3.

The pump 16 is effective in providing a high flow rate, at a given level, for a thermal transfer fluid such as "Galden HT 70" grade, or a 50/50 glycol/water mixture, which may be at temperatures from −40° C. to +70° C. At ambient pressures of one atmosphere, "Galden HT 70" has a boiling point of about 70° C., and while the temperatures needed for the process tool 30 of FIG. 1 do not approach this boiling point, the localized temperature in the immediate vicinity of the bearings 50, 52 may in fact approach or exceed such a level. Significant vaporization in the bearing gap would deteriorate the liquid film support and drastically or even catastrophically affect bearing life. Such conditions can occur when the maximum liquid that is being pumped involves heavy loading, i.e. high flow rates and pressures, because as noted above, the maximum temperature within the rotor housing 13 varies little more than 10° C. even though the liquid being pumped may vary across a range of 110° C. The localized temperature at the bearings under high stress can reach an absolute level of 110° C., which at one atmosphere, exceeds the boiling point of "Galden HT 70".

In accordance with the invention, however, the interconnection 40 between the high pressure outlet side of the pump 16, the radial port 22 and the central chamber 24 increases the interior pressure within the rotor housing 13 essentially to the output pressure level of the output fluid. Since essentially no flow of thermal transfer fluid is involved, and only hydraulic pressure is communicated, an output pressure of 80 psi from the pump 15 raises the boiling point at the hydrodynamic bearings to about 115° C., and this gain of 45° C. in boiling point renders localized evaporization unlikely. Since the power to drive the pump 16 is roughly proportional to the pressure being delivered, the temperature at which the bearings 50, 52 will fail is automatically raised as the pressure is changed. This approach thus offers a low cost solution that avoids more expensive expedients for cooling the bearings.

It will be appreciated that with different pump designs, other hydraulic pressure pathways may be used to communicate output pressure into the bearing regions. It should be noted that, with the presently described configuration, the higher pressure in the mid-region of the regenerative turbine disk does not introduce substantial back pressure to inflow or act to increase the stress on the pumping system. The peripheral channel and the turbine disk separate the incoming and outgoing flows so that they are adequately isolated and the pressure communicated into the rotor interior does not meaningfully increase motor load.

While there have been described above the illustrated in the drawings various forms and modifications of systems in accordance with the invention it should be appreciated that the invention is not limited thereto but encompasses all versions and expedients within the scope of the appended claims.

I claim:

1. A pumping system of the type comprising a motor including a rotor within a fluid filled enclosure having hydrodynamic bearings supporting a drive shaft with an extended end engaging a regenerative turbine pump, the pump driving a thermal transfer fluid which also fills the enclosure and provides the lubricating fluid for the hydrodynamic bearings, comprising:

a pump housing disposed about the extended end of the drive shaft and sealingly engaged to the rotor enclosure, the pump housing including a first interior narrow, circumferential chamber transverse to the drive shaft for receiving the regenerative turbine pump, and inlet and outlet ports in communication with opposite sides of the circumferential chamber adjacent its periphery;

a second interior chamber within the pump housing and about the drive shaft on the side closest to the rotor, and a first pressure communication conduit extending between the output port and said second interior chamber; and at least one second pressure communicating conduit intercoupling the second interior chamber to the interior of the rotor enclosure.

2. A pumping system as set forth in claim 1 above, wherein the motor is a variable speed motor, the fluid being pump is a thermal transfer fluid, and the first pressure communicating conduit is less than 5 mm in diameter.

3. A pumping system as set forth in claim 2 above, wherein the inlet port has an axis oriented substantially parallel relative to the drive shaft axis and opens to the periphery of the turbine in a selected peripheral region, wherein the outlet port is tangentially oriented relative to the circumference about the drive shaft axis, and includes a side opening to the periphery of the turbine in a region adjacent the selected peripheral region, wherein the pump housing includes a separator between the inlet and outlet ports in the region of the periphery of the turbine, and wherein the first interior conduit extends from between the side opening and the tangential outlet port through the housing into the second chamber.

4. A pumping system as set forth in claim 3 above, wherein the pump housing includes a hollow cylindrical sleeve about the shaft extending toward the rotor enclosure for engagement in sealable relation to the adjacent side of the rotor enclosure, wherein the regenerative turbine has a disk shaped body with an array of peripheral blades on each side thereof, wherein the pump housing includes a circumferential peripheral channel encompassing the peripheral blades on each side of the turbine, and wherein the inlet port is in communication with the peripheral channel on one side of the turbine and the outlet port is in communication with the peripheral channel on the other side of the turbine, and wherein the pump housing includes turbine side wall surfaces within the peripheral channels and spaced closely from the associated sides of the disk body of the turbine.

5. A pumping system as set forth in claim 1 above, wherein the motor is a variable speed motor, the fluid is a thermal transfer fluid, and variations in motor rotational rate used to meet load changes impel local temperature level increases at the bearings, and wherein the first and second pressure communicating conduits impart sufficient pressure differential changes with load increases to raise the fluid boiling point sufficiently to prevent localized evaporization in the region of the hydrodynamic bearings under a preselected load.

6. A pumping system as set forth in claim 1 above, wherein the at least one second pressure communicating conduit comprises a central bore within the shaft from the extending end of the drive shaft into the rotor enclosure and includes at least one conduit from the bore into the interior of the rotor enclosure.

7. A system for preventing localized vaporization, due to high load operation, at hydrodynamic bearings within a fluid filled rotor enclosure of a motor having a shaft driving a pump driving the same fluid that is within the enclosure, the system comprising:

a pump housing engaged to the rotor enclosure and including an interior fluid filled chamber in communication with the interior of the rotor enclosure, the pump housing encompassing an end portion of the motor shaft;

a turbine pump mounted on the end portion of the motor shaft and having peripheral blades;

separated fluid inlet and outlet passageways in the housing in communication with the peripheral blades of the turbine;

a driver circuit coupled to the motor for driving the turbine in accordance with the load conditions; and a fluid pressure communication system including at least one aperture in excess of about 1 mm in diameter coupling the fluid outlet passageway to the interior chamber of the pump housing and at least one pressure communicating conduit coupling the interior chamber of the pump housing to the rotor enclosure interior to increase the fluid pressure within the rotor enclosure automatically in accordance with increased load on the pump.

8. A system is set forth in claim 7 above, wherein the aperture coupling the fluid outlet passageway to the interior chamber of the pump housing is in the range of about 1.0 to about 1.5 mm in diameter.

* * * * *